United States Patent [19]

Danis, Jr.

[11] 4,170,852

[45] Oct. 16, 1979

[54] ARTICULATED PREFABRICATED MODULAR BUILDING AND METHOD OF ERECTING THE SAME

[75] Inventor: Benjamin G. Danis, Jr., Dayton, Ohio

[73] Assignee: Danis Industries Corporation, Dayton, Ohio

[21] Appl. No.: 855,215

[22] Filed: Nov. 28, 1977

[51] Int. Cl.[2] ..... E04B 1/343

[52] U.S. Cl. ..... 52/71; 52/641; 52/741

[58] Field of Search ..... 52/645, 646, 641, 71, 52/122, 125, 741

[56] References Cited

U.S. PATENT DOCUMENTS

| | | | |
|---|---|---|---|
| 2,350,904 | 6/1944 | King | 52/641 X |
| 2,549,816 | 4/1951 | Johnson | 52/641 |
| 3,296,752 | 1/1967 | Philp | 52/641 X |
| 3,593,482 | 7/1971 | Johnson | 52/122 X |
| 3,774,356 | 11/1973 | Philp | 52/641 X |
| 3,968,618 | 7/1976 | Johnson | 52/71 X |
| 3,971,185 | 7/1976 | Hendrich | 52/71 X |

*Primary Examiner*—Ernest R. Purser
*Assistant Examiner*—Carl D. Friedman
*Attorney, Agent, or Firm*—Biebel, French & Nauman

[57] ABSTRACT

An articulated prefabricated modular building structure is provided having a pair of roof panels hingedly interconnected so as to be movable between a position in which the panels are disposed in a common horizontal plane to a position in which the panels are at a desired roof slope inclination, a pair of side wall panels each hingedly secured to a respective roof panel and movable between a folded position parallel to and underlying a respective roof panel and said inclined position, means for releasably holding the side wall panels in the folded position during transport of the structure to an erection site and means defined on the outer edges of the roof panels for engagement by a lifting device for positioning a structure at the erection site, the defined means in the roof panels lying in a plane orthogonal to the roof panel and substantially containing the center of gravity of that panel and an associated side wall panel when the side wall panel is in the folded position. This structure assists in erection of the building by automatically inclining the roof panels and side wall panels to the desired relative inclination upon removing of the releasable means which hold the side wall panels in the folded position, since this results in a change in the center of gravity of the interconnected panels from the points at which the panels are being lifted they will assume the appropriate inclined position so that the wall panels can then merely be secured to the foundation.

8 Claims, 9 Drawing Figures

ARTICULATED PREFABRICATED MODULAR BUILDING AND METHOD OF ERECTING THE SAME

BACKGROUND OF THE INVENTION

1. Field of the Invention

The present invention relates to building structures, and more particularly, to modular prefabricated building structures which can be secured together at a building site to form a building of any desired length.

2. Prior Art

There are many forms of articulated prefabricated buildings which can be collapsed in order to transport them from the fabrication factory to the building site where they are then unfolded, erected and secured to a foundation along with a plurality of other similar units so as to form a building shell of any desired length. Such modular building structures usually are formed of articulated roof and side wall panels all of which are connected when fabricated so that only minor assembly, such as placing support braces etc . . . in position between the roofs and side panels, need be made at the erection site.

Such a building is disclosed, for example, in Philp U.S. Pat. No. 3,296,752 and Harvey U.S. Pat. No. 414,976. These two patents disclose foldable building structures of somewhat different construction, but both are designed to be fabricated in modular form at a factory and then folded until they are transported to a building site where upon they are unfolded and erected to form a building of the desired length.

One problem which exists in all such portable buildings is that they are generally transported by a flat bed tractor trailer or a railroad car, which imposes certain restraints on the configuration both in its overall dimensions and its folded form. The buildings must be collapsible in such a manner as to come within the confines of the tractor trailer or other vehicle in which they are to be transported and should in addition be foldable in such a manner that they can be compatably stacked and secured in position without loss of substantial space due to irregular configurations in this folded position.

Difficulty occurs, for example, when the modules are fabricated in such a manner that in their folded positions there are substantial protrusions which can not be intermeshed with corresponding protrusions on similar modules all of which are stacked on the transporting vehicle. Such construction reduces the number of modules which can be transported by a single vehicle and therefore can substantially increase the cost of transportation and in some cases makes the cost prohibitive when the erection site is a substantial distance from the point of fabrication.

If, for example, the construction is such that two roof panels and two side wall panels are interconnected in such a manner that they are all folded one upon another in an accordian like fashion, as is the case with some conventionally known structures such as those mentioned above, the roof or the side wall panels will extend beyond the main envelope of the folded module and would not be compatable with like folded modules so as to be transportable without substantial loss of space due to this lack of interface. Further, buildings which are fabricated in such a manner as to be folded in an accordian like fashion require substantial manipulation and end-for-end rotation in order to unfold the side walls of the roof panels so that they may be erected and secured to a foundation. Often this requires the use of a crane and the fastening and unfastening of flexible guide lines several times on a single module before it can finally be erected and secured to the foundation. Thus, substantial labor is involved in the erection of such buildings which reduces their competitive advantage over erection of a building at a site in a more conventional manner.

A yet further difficulty associated with the erection of such conventional modular buildings is that after they have been at least partially unfolded so that the roof panels and side wall panels will fall into position as the module is raised by an overhead crane, the construction is such that after the module has been partially raised bracing members must be applied in order to stop further rotation of the roof panels and the side wall panels relative to one another beyond the position at which it is desired to have them erected. This requires substantial work on the module structure as well as further manipulation by the crane operator which is labor consuming, thus again reducing the cost advantage of such prefabricated structures.

SUMMARY OF THE INVENTION

The present invention overcomes the above described disadvantages and difficulties associated with such prior art devices by generally providing an articulated prefabricated modular building structure which is fabricated to lie substantially flat and present a substantially uniform rectangular cross sectioned envelope for ease of transportation to the erection site and which can be easily erected by lifting each module and releasing appropriate pins which automatically causes the building to assume the erected position.

The invention basically comprises an articulated prefabricated modular building structure having a pair of roof panels hingedly interconnected at adjacent edges and hingedly connected on their opposite edges to side wall panels which can be folded under and against the roof panels while the roof panels are lying in a horizontal plane. The interconnected end portions of the roof panels are provided with a limit stop at a desired angle of inclination between the roof panels when in an erected position. The roof panels are pivotal between a position in which the panels are disposed in a common horizontal plane and a position in which the panels are in a desired inclination of roof slope.

The side wall panels are hingedly connected at their upper end portions to outer end portions of the roof panels and are also provided with limit stops at a desired angle of relative inclination between the respective side wall panel and roof panel. Each side wall panel is pivotally movable between a folded position parallel to and underlying the respective roof panel to which it is attached, and the relatively inclined erected position.

Means are provided for releasably holding the wall panels in the folded position during transport of the structure to an erection site. The roof panels are provided with means on the outer side edge portions of each for engagement by a lifting means in order to position the structure at the site of erection, the defined means on each roof panel lying in a plane orthogonal to that roof panel and substantially containing the center of gravity of that panel and an associated side wall panel when the side wall panel is in the folded position.

It is apparent that the positioning of the connecting means, i.e. the means defined in the side edge portions of the roof panels, is an important feature of the present invention since it permits almost automatic assembly upon releasing of the means holding the wall panels in the folded position. By placing the connecting means at a plane passing through the center of gravity when the side wall panel is in the folded position, it allows the module to be lifted from the truck bed or other vehicle in which it is being transported, and remain substantially in a horizontal position while it is moved to a nearby erecting site. Once the module is in position, the means holding the wall panels in their folded position can be released which results in a change in the center of gravity of the roof panels and the interconnected side wall panels such that the interconnected end portions of the roof panels will move upwardly as the side wall panels fall downwardly.

In its preferred form, the invention also includes limit stops being formed on adjacent edge portions of both the interconnected end portions of the roof panels and the opposite end portions of the roof panels and the associated upper ends of the connecting side wall panels. The limit stops are so formed that as the side wall panels and roof panels are unfolded they will stop at the desired relative angles of inclination without need for adjustment by the workers assemblying the building.

This is best accomplished by pivotally interconnecting the adjacent end portions of the roof panels at the mid point of the thickness of the roof panels and by angling the facing edge portions of the roof panels so as to diverge outwardly from one another from the top edge to the bottom edge. This will result in the top edges of the roof panels being in abutting relation when the module is disposed in a horizontal plane, such as for shipment, and will thus assist in maintaining this horizontal position when the modules are being lifted from the vehicle. The angle of inclination of these edges is such that once the side walls are unfolded the roof panels will move to the desired angle of slope for the roof so that the bottom edges of the facing edge portions are in abutting relation to hold the roof panels in the desired roof slope position.

As mentioned, the interconnected end portions of the roof panels are preferably hinged at the mid point of their thickness. This can be easily accomplished by using hinge plates extending outwardly along the outer side edges of each roof panel towards one another and overlapping so that holes defined in each adjacent hinge plate will be in alignment. Hinge pins may then be inserted in the hole on each pair of hinge plates on each side of the pair of roof panels to form the pivotal axis of the roof panels for movement from the folded position to the inclined position.

A further preferred aspect of the present invention, utilizes a pair of rod members providing structural bracing between the side wall panels and their adjacent roof panels. In its preferred form one end of each rod is secured such as by welding, to an upper side edge of a side wall panel and the opposite end is pivotally connected to the adjacent side edge portion of the roof panel. This forms the hinged connection between the side wall panel and the roof panel in such a manner that the side wall panels are movable between the folded position and the erected position.

A yet further preferred aspect of the present invention involves the use of bracing members interconnecting the roof panels adjacent the hingedly interconnected end portions thereof. This involves a bracing member on each side of the module being pivotally secured at one end to one of the roof panels and being slidingly supported at the opposite end by a guide structure on the other roof panel, in such a manner that when the roof panels are in the folded position with the roof panels in a horizontal plane the bracing member will be contained within the envelope defined by the roof panels so as not to interfere with stacking of the panels. The guided end portions will move along the guiding surface from the folded position until the roof assumes the desired angle of roof inclination when it is erected so that the guided end portion of the bracing member, which has a hole therein, will come into alignment with a corresponding hole on the edge of the roof panel and can thus be immediately bolted through these holes without further need for alignment.

It is therefore an object of the present invention to provided an articulated prefabricated modular building structure which can be easily transported to a building erection site and can be erected with a minimum of labor.

It is a further object of the present invention to provide such a building module in which the roof panels and side wall panels when in the folded position are lifted at positions which contain the center of gravity of each roof panel and its associated side wall panel when in the folded position so that they will remain in a horizontal position when lifted and which will assume an inclined position in the appropriate direction when the side wall panels are unfolded to their erected position.

Other objects and advantages of the invention will be apparent from the following description, the accompanying drawings and the appended claims.

DETAILED DESCRIPTION OF THE PREFERRED METHOD AND EMBODIMENT

Figure 1:
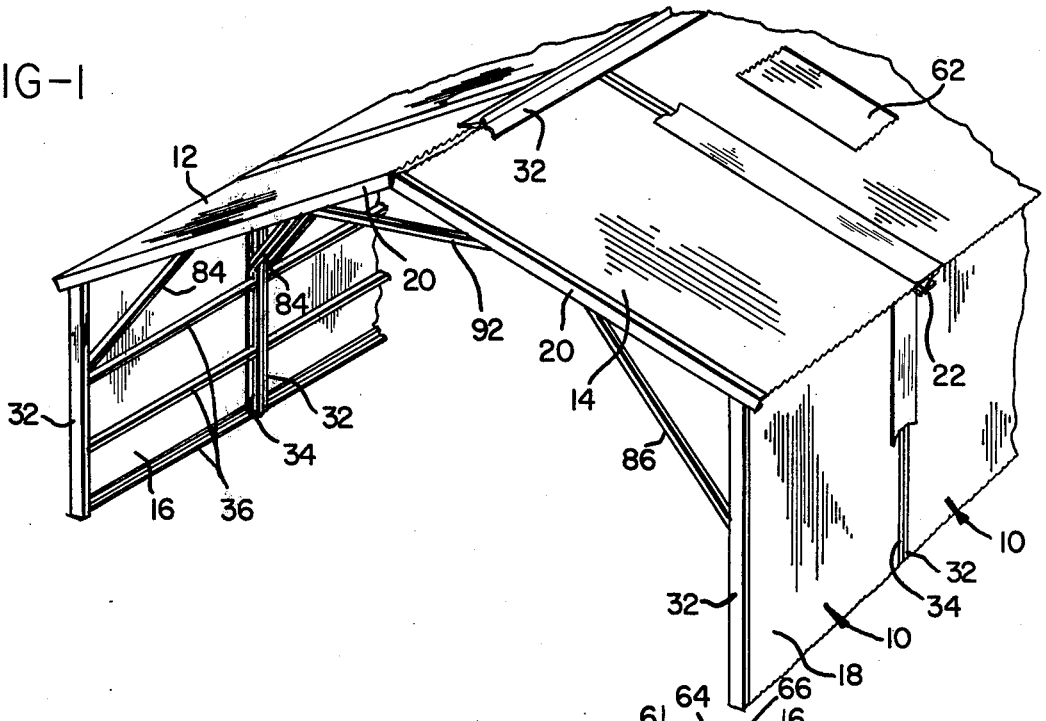
FIG. 1 is a partially cut away pictorial view of a portion of a building constructed of modular structures made in accordance with the present invention.
Figure 9:
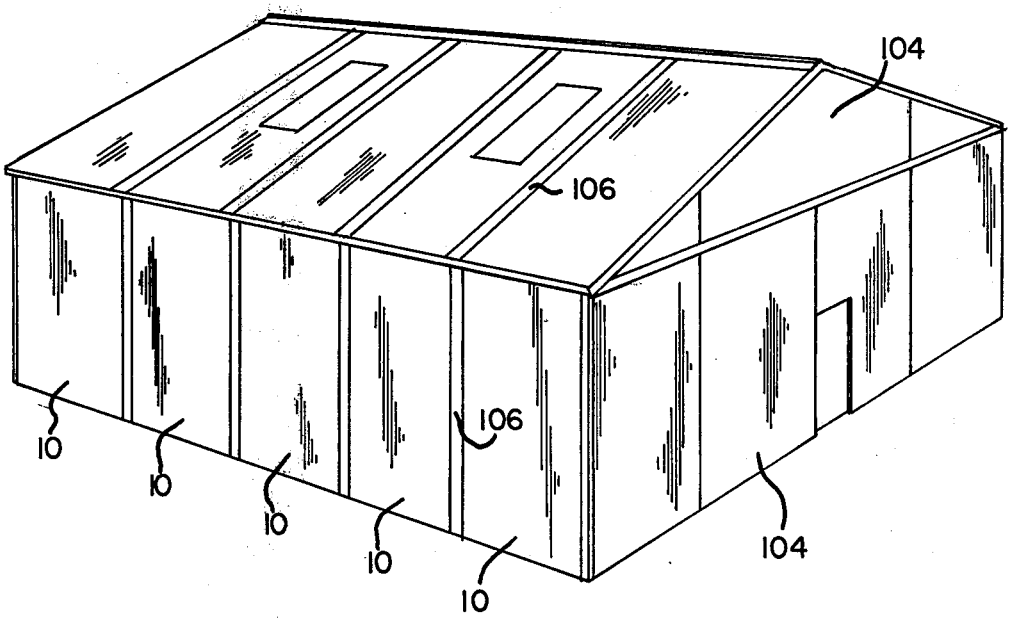
FIG. 9 is a pictorial illustration of a completed building utilizing the modular sections of the preferred embodiment and having additional end wall pieces secured in place.

A building structure such as that illustrated in FIGS. 1 and 9 is constructed for the most part by utilizing a plurality of modular structures 10 which form the subject matter of the present invention. Each modular structure 10 basically comprises a pair of roof panels 12 and 14 and a pair of side wall panels 16 and 18. Each of the roof panels and side wall panels is of generally the same construction having a frame structure made of channel iron or the like which supports corrugated sheet metal panels and insulation material, as described in more detail below.

Figure 2:
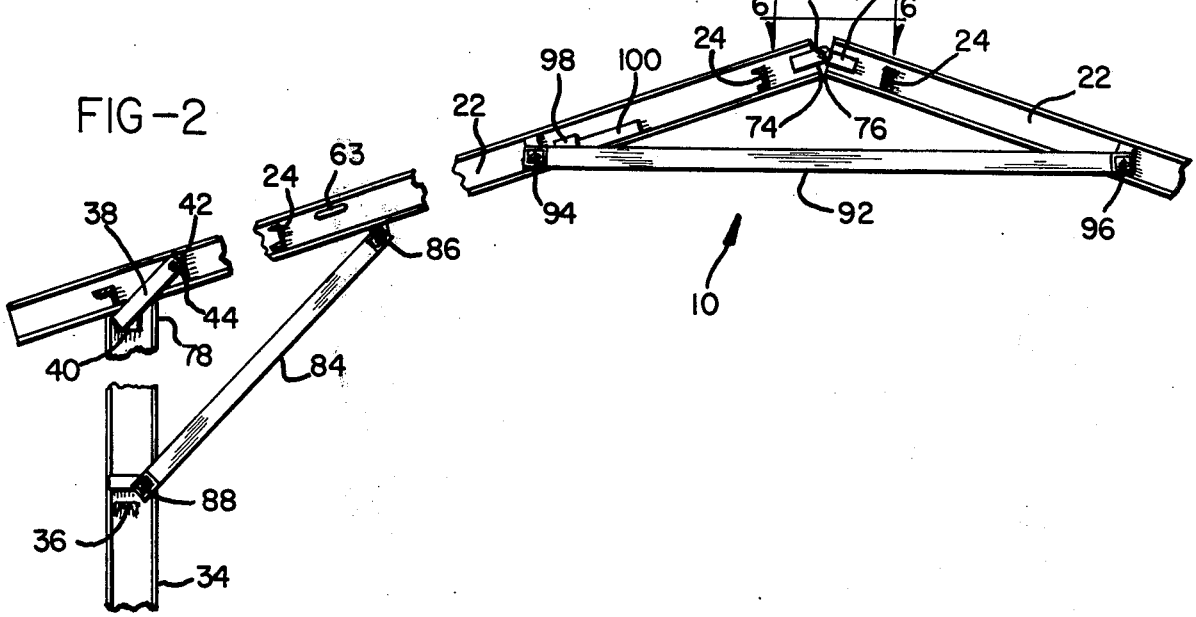
FIG. 2 is a broken end elevational view of the frame structure of the module of the preferred embodiment in an erected position.

Each roof panel has a frame structure comprising a pair of spaced parallel main support members 20 and 22 preferably made of channel iron, which are interconnected by welding a series of smaller cross braces 24 also preferably made of channel iron, in spaced parallel relation between members 20 and 22, as best seen in FIG. 2.

Figure 6:
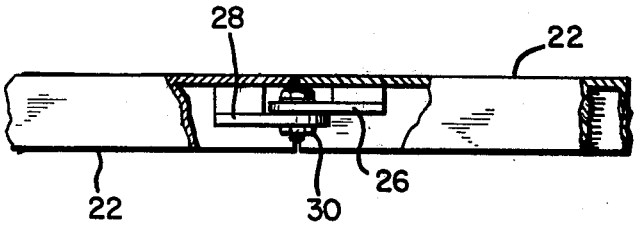
FIG. 6 is a partially cut away view of the hinged connection on one side of a pair of interconnected roof panels in the direction of line 6—6 of FIG. 2.

Referring to the articulated frame structure as best seen in FIG. 2, a pair of main support members 22 are illustrated in an erected position. It is to be noted that although the following description is given with respect to only one side of a pair of interconnected roof panels 12 and 14, each set of corresponding support member 20 as well as each set of corresponding support members 22 are interconnected in the same manner. The connection is preferably accomplished by using a pair of hinge plates 26 and 28 which are shown in greater detail in FIG. 6. Basically, they are made of steel plates supported on steel blocks 27 and 29 which each of which is welded to its respective hinge plate and then welded within the channels of the channel irons so that holes defined in the outer end portions of each are aligned for placing a bolt 30 therein which acts as a hinge pin for one side of the interconnected end portions of the side edges of the roof panels 12 and 14. The hinge plates 26 and 28 are secured at approximately the middle of the thickness of the support members 20 and 22. There are several important advantages in locating the hinge point between the roof panels in this position.

First, it eliminates the use of a hinge above the profile of the roof panels and thus permits the use of a smaller and less intricate ridge cap 32, as seen in FIG. 1, then is the case with conventional articulated roof panels in which the hinge point is above the general profile of the roof panels. Second, it permits control over movement of the interconnected roof panels, relative to one another when they are being erected, as is more fully described below.

Referring again more particularly to FIGS. 1 and 2, the side wall panels 16 and 18 are generally constructed in essentially the same manner as roof panels 12 and 14 in that they each have a frame structure composed of a pair of spaced parallel main support members 32 and 34, preferably made of channel iron, which are interconnected by welding smaller cross braces 36, also preferably made of channel iron, in spaced parallel relation along the height of the side wall panels.

Each side wall panel 16 and 18 is connected at each side of its upper end portion to each side of a corresponding end portion of a roof panel, as illustrated in FIG. 2. Referring to the manner in which one side is connected, the other side being similarly connected, a rod member 38 is secured at one end portion 40 such as by welding or the like, to the support member 34 and has its opposite end portion 42 pivotally connected to the support member 22 of a roof panel. In order to make the pivotal connection a plate 44 is welded inside the channel to the opposite walls and has a hole defined therein which aligns with the hole in the end portion 42 of rod member 38 and through which a bolt is secured to act as a hinge pin.

Figure 7:
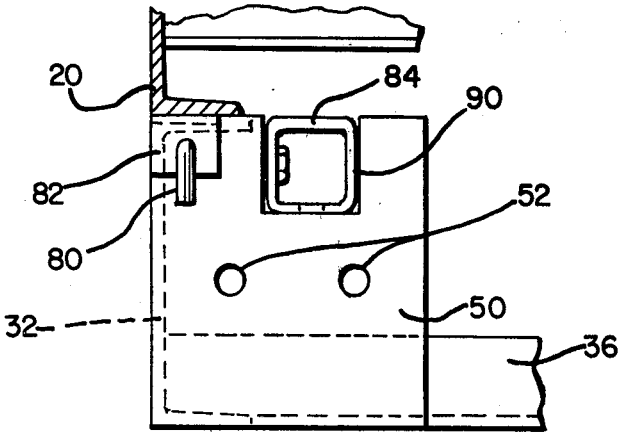
FIG. 7 is an enlarged partial cross sectional view of the base of a side wall panel and a portion of a roof panel in the folded position as seen in the direction of line 7—7 of FIG. 5.

The bottom edge portion 48 of each support member 32 and 34 of the side wall panels 16 and 18 is fitted with a plate 50, as best seen in FIG. 7. Plate 50 is welded to the bottom of support member 34 and is provided with a plurality of holes 52 for securing the side wall panels to bolts fitted in a foundation on which the module is to be supported.

Figure 3:
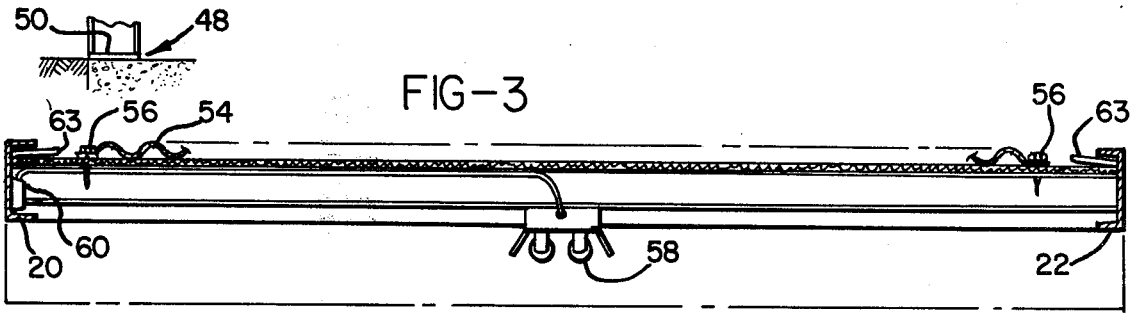
FIG. 3 is a cross sectional view transverse to a roof panel of the preferred embodiment.
Figure 4:
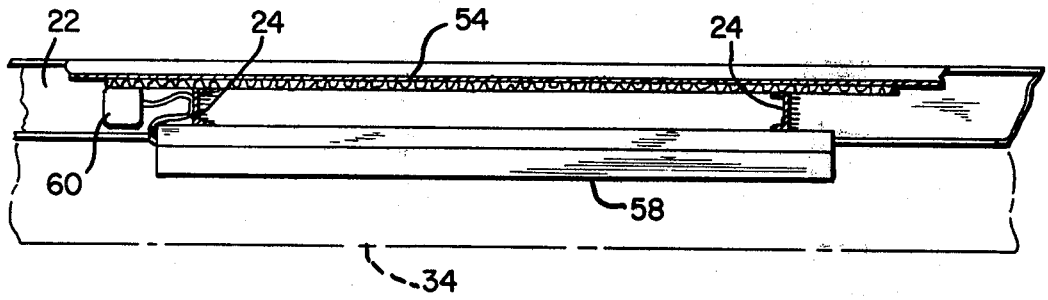
FIG. 4 is a partial cross sectional view longitudinally of a roof panel of the preferred embodiment.

In addition to the frame structures described above forming both the roof panels and side wall panels of each modular structure 10, a layer of corrugated galvanized steel sheet is secured to the plurality of cross braces 24 and 36 by a series of self tapping screws 56 along each side of the sheet 54, as seen in FIGS. 3 and 4. Sandwiched between the corrugated sheet 54 and the cross braces 24 and 36 is a layer of insulative material, such as foil backed fiberglass, which is held in place by screws 56 and the pressure of the corrugated sheet 54 against the cross braces 24 and 36. It is to be noted that although FIGS. 3 and 4 depict the roof panel construction, the construction is essentially the same for the side panels with the exception of the lighting fixtures and associated connections as described below.

The roof panels 12 and 14 can additionally be provided with fluorescent lighting fixtures 58 which are prewired during fabrication to a connection box 60 which can then all be interconnected in the various modules to assist in ease of assembly. Preassembly of the lighting fixtures to the roof panels is made possible by the unique design of the present invention in that as is seen by the phantom outline in FIGS. 3 and 4 of the support members 32 and 34 shown in the folded position, they form a protective box around the fixtures and prevent their being broken during transport to the building erection site.

In addition to the lighting fixtures 58 it is contemplated that sky light panels 62 as shown in FIG. 1, can also be provided in at least some of the roof panels in order to provide additional natural lighting within the building. It is contemplated that the sky light members 62 can be made in the form of corrugated translucent fiberglass panels as are conventionally available and that a correspondingly dimensioned opening in the insulation under the corrugated sheet 54 in registry with panel 62 is to be provided in order to permit the light to enter the building.

In order to lift the modular structures 10 from the vehicle in which they are transported to the erection site and for the purpose of lifting them during erection of a building, a pair of U-shaped members 63 such as a conventional U-bolt are secured, such as by welding, to each roof panel 12 and 14. One U-shaped member 63 is secured to each main support member 20 and 22 in alignment transverse to each roof panel and at a specific location longitudinally of each roof panel. The specific location of securing U-shaped members 63 is at a position where they will be aligned in a plane perpendicular to the roof panel and passing through the center of gravity of the roof panel and its associated side wall panel when the side wall panel is in the folded position as illustrated for example in FIG. 5. The U-shaped members 63 are preferably welded inside the channel member to the upper wall thereof where they can be easily accessed to insert a crane hook (not shown) on the end of a flexible lead 65 which can then be attached to a crane hoist for lifting. It is to be noted that since the galvanized sheet 54 does not extend completely across the roof panels there is sufficient space provided in which to insert the crane hook in the U-shaped members 63 for lifting.

Referring now to the manner in which each modular structure 10 is articulated for erection at a building site, it is to be noted that an important aspect of the present invention is that the interconnected end portions of the roof panels as well as the interconnected end portions of the side wall panels and associated roof panels are provided with movement limit stops. The limit stops between the interconnected end portions of the roof panels in the preferred embodiment is provided by inclined edges 64 and 66 formed on each of the support members 20 and 22. The actual angle of inclination of edges 64 and 66 relative to the longitudinal plane of support members 20 and 22 will vary depending upon the thickness of the support members and the desired angle of roof inclination.

Figure 5:
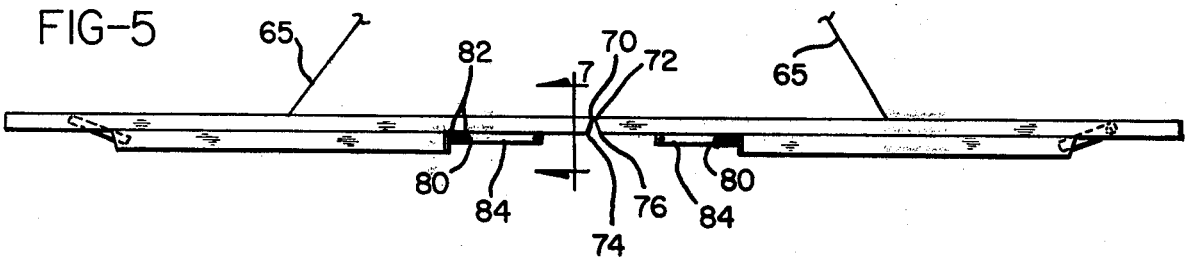
FIG. 5 is a side view of a module of the preferred embodiment in the folded position.

However, it can easily be established what the angle of inclination should be for given dimensions of support members since the limit stop should preferably be so designed that when the roof panels are in the horizontal position as shown in FIG. 5, the upper edges 68 and 70 of the inclined edge portions 64 and 66 will be in abutting relation. This is so that the roof panels cannot be folded upward substantially beyond the horizontal position shown in FIG. 5. However, it is to be noted that this particular limit stop is not essential since when the modules are lifted in the folded position by the U-shaped members 63 they will tend to stay in a horizontal position.

The opposite edges 74 and 76 of inclined edge portions 64 and 66 are likewise intended to provide limit stops, but at the desired angle of inclination of the roof panels when in the erected position as shown in FIG. 2. Thus, for a particular building design the angle of inclination of the edge portions 64 and 66 can be established by the above described limit stop parameters. In addition, it is also to be noted that the distance of separation between the edge portions 64 and 66 must be maintained sufficiently small to permit the inclined edge portions to abut in both the folded, if desired, and erected positions described above.

The upper portions of the side wall panels are also provided with a specific inclination in order to provide a limit stop in the erected position. As best seen in FIG. 2, the upper end portion 78 of side wall panel support member 34 is inclined outwardly and downwardly at an angle which permits the inclined end portion to abut in surface-to-surface contact with the bottom edge of the associated support member 22 on the roof panel in order to provide support for the roof panel. The other side wall panel support member 32 has its upper end portion inclined in a similar manner to abut roof panel support member 20 in like manner.

When the side wall panels 16 and 18 are in the folded position illustrated in FIG. 5, they are held against the bottom surfaces of the roof panels 12 and 14 by L-shaped pins 80 which extend through a pair of brackets 82 welded to each channel member 22 and 24 and which have holes in alignment with a hole in the base plate 50 to releasably hold the side wall panels in the folded position.

A pair of side wall braces 84 and 86 are also provided on each side of module 10 in order to add additional rigidity to the erected modular structure. Referring to brace 84 as an example of how they are connected, side wall brace 84, as shown in FIG. 2, is connected by bolts at each end to plates welded to the roof panel support member 22 and side wall support member 34. When the side wall panels are in the folded position end 87 of brace 84 is left unbolted and end portion 88 is loosely bolted so that brace 84 may be pivotally rotated to within the side wall support member 34 and be supported in a U-shaped opening 90 defined in the base plate 50 (as shown in FIG. 7 for support member 32) and thus hold the brace 84 within the envelope defined by the folded structure. When the building is erected the brace 84 is merely pivoted upward so that it can be bolted to the roof panel.

A pair of ridge braces 92 are also provided in order to give additional rigidity to the modular structure 10. Each ridge brace in the erected position is secured at its end portions by bolts extending through brackets welded to the roof support members 20 and 22. However, when each modular structure 10 is in the folded position, for example, end portion 94 of ridge brace 92 is unbolted and end portion 96 is loosely bolted to permit the brace to be pivoted slightly. In addition, an inverted U-shaped channel member 98 is welded to the back of ridge brace 92 in alignment with a plate 100 welded to the lower wall of support member 22 as seen in FIG. 2, which acts as a guide to permit the end portion 94 of brace 92 to slide along the channel 100 from the folded position in which the brace 92 lies within the envelope formed by support member 22, to the erected position where end portion 94 is aligned with the bolt hole on support member 22 when the roof panel edges 74 and 76 are in abutting relation. This automatically aligns the holes in end portion 94 and the bracket welded to support member 22 so that a worker merely needs to insert the bolt in position and tighten the bolts at each end of the ridge brace to provide rigidity to the roof panels. The same construction is used on the ridge brace 92 attached between support members 20.

Figure 8:
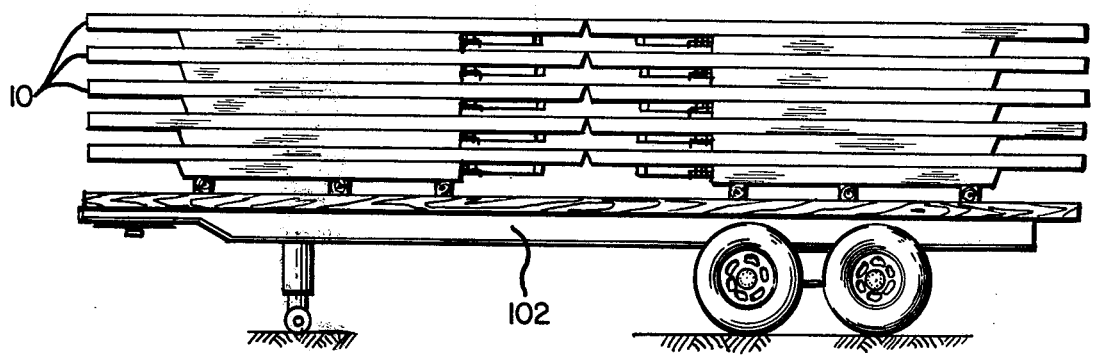
FIG. 8 is a pictorial illustration of a plurality of modules of the preferred embodiment stacked on a trailer for transportation to a building site.

Because of the unique construction of the present invention, a plurality of modular structures 10 can be easily stacked for shipment as shown in FIG. 8, on the bed of a tractor trailer 102 for shipment from the fabrication site to the building erection site. It can be seen that there is little loss in space because the envelopes formed by the folded structures are symmetrical and stacked easily.

When the building is fully erected as shown in FIG. 9, end wall panels 104 are used to form the ends of the building of whatever desired length. The end wall panels are fabricated from similar channel members, insulation and corrogated sheet material as are the roof and side wall panels described above. Also, since the corrogated sheets 54 of both the roof and side wall panels are narrower than the width of the panels flashing material 106 is used to cover the exposed insulation and joint between adjacent modular structures 10 by securing it overlapping corrogated sheets 54. Flashing 106 can also be of corrogated galvanized sheet material, if desired.

While the method herein described, and the form of apparatus for carrying this material into effect, constitute preferred embodiments of the invention, it is to be understood that the invention is not limited to this precise method and form of apparatus, and that changes may be made in either without departing from the scope of the invention.

What is claimed is:

1. An articulated prefabricated modular building structure, comprising:

a pair of roof panels hingedly interconnected at adjacent end portions thereof and pivotal between a position in which said panels are disposed in a common horizontal plane and a position in which said panels are at a desired angle of inclination relative to one another so as to form a sloping roof;

a pair of side wall panels one each hingedly secured at an upper end portion to a respective one of said roof panels at end portions thereof remote from said interconnected end portions, said side wall panels each being movable between a folded position parallel to and underlying a respective roof panel and an erected position where said side wall panels are inclined relative to said roof panels;

means releasably holding said side wall panels in said folded position during transport of said structure to a site for erection; and means defined on outer side edge portions of each roof panel for engagement by a lifting means for positioning said structure at a site for erection, said defined means on each roof panel lying in a plane orthogonal to that roof panel and substantially containing the center of gravity of that panel and an associated side wall panel when said side wall panel is in said folded position.

2. A structure as defined in claim 1 wherein said interconnected end portions of said roof panels are formed to provide a limit stop at said desired angle of inclination between said roof panels shown in said erected position, and each said remote end portion of said roof panels and corresponding upper end portions of said side wall panels are formed to provide a limit stop in said erected position.

3. A structure as defined in claim 2 including a hinge means for hingedly interconnecting said roof panels, said hinge means comprising hinge plates secured to each said outer side edge portion of said roof panels and having aligned holes defined therein at about the mid portion of the thickness of said roof panels, and pins extending through said holes in adjacent ones of said hinge plates and forming the relative axis of rotation of said roof panels.

4. A structure as defined in claim 3 wherein in order to form said roof panel limit stop said interconnected end portions of said roof panels are formed with upper abutting edges when said roof panels are in said common horizontal plane and the remainder of said interconnected end portions are inclined at a relative diverging angle sufficient to permit said roof panels to be inclined at a predetermined angle in an erected position.

5. A structure as defined in claim 4 wherein in order to form said side wall panel limit stop said remote end portions of said roof panels and said corresponding upper end portions of said side wall panels are formed with outer edges which abutt when said structure is in an erected position.

6. A structure as defined in claim 5 including hinge means for hingedly securing said roof panels to said respective side wall panels, said hinge means comprising a plurality of rod members each fixedly secured at one end to a side edge of one of said side wall panels and pivotally connected at an opposite end to a respective said roof panel, said rod members being so positioned that said side wall panels are movable between said folded position and said erected position.

7. A structure as defined in claim 6 including bracing members connected to side edge portions of said roof panels for bracing said structure when in said erected position, each said bracing member having one end pivotally secured to one of said roof panels and an opposite end guidingly supported in the other of said roof panels for movement between a folded position within the envelope defined by said roof panels when in said horizontal plane and an erected position wherein said opposite end portion of said bracing member has a hole defined therein in alignment with a corresponding hole in said other roof panel for inserting a bolt to hole each said bracing member in said erected position.

8. A method of erecting a articulated prefabricated modular building in which each module comprises two roof panels hingedly coupled together and two side wall panels one each hingedly connected to a respective roof panel and means releasably holding said side wall panels folded against their respective roof panels prior to erection, the steps comprising:

positioning said roof panels in an extended horizontal position with said side wall panels folded thereunder;

attaching lifting means to each said roof panel on two opposed sides there of at points which are in a plane orthogonal to and substantially passing through the center of gravity of said panel and its associated side wall panel when in said folded position;

lifting said panels with said lifting means to a height greater than the erected height of the building;

releasing said holding means to allow said side wall panels to unfold to a vertical position and so as to cause said roof panels to assume an inclined roof position;

lowering said module onto a foundation structure and securing said side walls thereto.

* * * * *